US009334578B2

(12) United States Patent
Takeguchi

(10) Patent No.: US 9,334,578 B2
(45) Date of Patent: May 10, 2016

(54) ELECTROPLATING APPARATUS AND METHOD WITH UNIFORMITY IMPROVEMENT

(75) Inventor: Naoki Takeguchi, Aizuwakamatsu (JP)

(73) Assignee: Cypress Semiconductor Corporation, San Jose, CA (US)

( * ) Notice: Subject to any disclaimer, the term of this patent is extended or adjusted under 35 U.S.C. 154(b) by 1380 days.

(21) Appl. No.: 12/273,289

(22) Filed: Nov. 18, 2008

(65) Prior Publication Data

US 2010/0122908 A1 May 20, 2010

(51) Int. Cl.

| | |
|---|---|
| ***C25D 21/12*** | (2006.01) |
| ***C25D 7/12*** | (2006.01) |
| ***C25D 17/00*** | (2006.01) |
| ***C25D 5/18*** | (2006.01) |
| ***C25D 17/12*** | (2006.01) |

(52) U.S. Cl.

CPC *C25D 21/12* (2013.01); *C25D 5/18* (2013.01); *C25D 7/123* (2013.01); *C25D 17/001* (2013.01); *C25D 17/12* (2013.01)

(58) Field of Classification Search

CPC ..... C25D 21/12; C25D 17/001; C25D 7/123; H01L 21/76873

USPC ..... 204/228.1; 205/83

See application file for complete search history.

(56) References Cited

U.S. PATENT DOCUMENTS

| | | | | |
|---|---|---|---|---|
| 3,622,471 | A * | 11/1971 | Cooke et al. | 205/83 |
| 5,503,730 | A * | 4/1996 | Osano et al. | 205/83 |
| 6,322,674 | B1 * | 11/2001 | Berner et al. | 204/212 |
| 6,440,291 | B1 * | 8/2002 | Henri et al. | 205/205 |
| 2004/0000485 | A1 * | 1/2004 | Preusse et al. | 205/83 |
| 2005/0173241 | A1 * | 8/2005 | Chalupa et al. | 204/228.9 |
| 2006/0144698 | A1 * | 7/2006 | Hsu et al. | 204/228.3 |
| 2006/0163074 | A1 * | 7/2006 | Manens et al. | 205/81 |
| 2007/0221502 | A1 * | 9/2007 | Wilson et al. | 205/83 |

FOREIGN PATENT DOCUMENTS

| | | | |
|---|---|---|---|
| JP | 2001-115297 | A | 4/2001 |
| JP | 2001-152396 | A | 6/2001 |
| JP | 2005-133113 | A | 5/2005 |

OTHER PUBLICATIONS

English-Language Abstract for Japanese Patent Publication No. 2001-115297 A, published Apr. 24, 2001; 1 page.

English-Language Abstract for Japanese Patent Publication No. 2001-152396 A, published Jun. 5, 2001; 1 page.

English-Language Abstract for Japanese Patent Publication No. 2005-133113 A, published May 26, 2005; 1 page.

* cited by examiner

*Primary Examiner* — Bryan D. Ripa

(57) ABSTRACT

An electroplating system is provided. The electroplating system includes a divided electrode that is arranged to simultaneously provide a plurality of line currents for an electroplating process. The system includes a current control component that is coupled to the divided electrode. The current control component is configured to determine the magnitude of each of the line currents. The current control component is also configured to regulate individual line currents based, at least in part, on the determined magnitude of each of the line currents.

13 Claims, 4 Drawing Sheets

ELECTROPLATING APPARATUS AND METHOD WITH UNIFORMITY IMPROVEMENT

FIELD OF THE INVENTION

The invention is related to electroplating, and in particular but not exclusively, to apparatus and methods for providing line currents in an electroplating process.

BACKGROUND OF THE INVENTION

Microelectronic device fabricators often employ electroplating processes to from conductive metal lines, contacts, vias and other elements on and within a microelectronic workpiece. For example, such conductive features can interconnect various levels of the workpiece or die areas within the workpiece. Typically, electroplating processes involve immersing at least the surface of the workpiece in a conductive solution of a desired material and passing an electrical current through the solution and conductive portions of the workpiece. As the current passes through the solution, cations of the desired material are reduced and conductive portions of the surface are coated with the material. A variety of metallic films or features can be created in this manner, such as copper and/or aluminum films or features.

BRIEF DESCRIPTION OF THE DRAWINGS

Non-limiting and non-exhaustive embodiments of the present invention are described with reference to the following drawings, in which.

DETAILED DESCRIPTION

Figure 1:
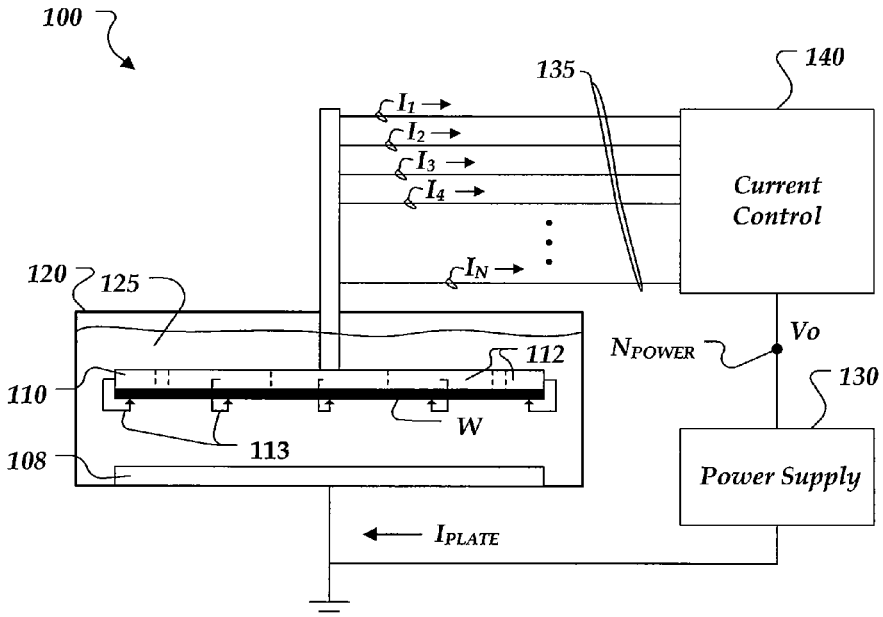
FIG. 1 is a block diagram of an embodiment of an electroplating system.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take the meanings explicitly associated herein, unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

The term "microelectronic workpiece" as used herein refers to any of a wide variety structures in which microelectronic devices, components, and/or features may be formed. In general, a microelectronic workpiece includes a substrate of one or more semiconductor materials, such as a group IV semiconductor material (e.g., silicon or germanium) or compound semiconductor materials (e.g., Gallium Arsenide, Indium Phosphide, and the like). The substrate is typically a front end of line (FEOL) layer. The substrate can also be configured to carry a middle of line (MOL) layer and/or a back end of line (BEOL) layer. For example, an MOL layer can include silicide, dielectrics, polysilicon, metal contacts, and the like, while the BEOL layer can include inter-level dielectrics, metal lines, vias, and contacts. In general, embodiments of electroplating processes can be employed to electroplate one or more portions of an FEOL layer, an MOL layer, and/or a BEOL layer to form any of a myriad microelectronic structures, devices, components, and/or features.

Further, although described in the context of electroplating microelectronic workpieces, the invention is not so limited. A skilled artisan will appreciate that electroplating processes can be carried out to electroplate other types of structures.

Also, embodiments of electroplating methods may be employed to produce conductive features for any of a wide variety of electronic devices and/or components. For example, embodiments of the invention can be employed to fabricate memory. In one embodiment, electroplating processes can be employed to fabricate flash memory employing single-bit, dual-bit, and/or multi-bit memory cells. In another embodiment, electroplating processes can be employed to fabricate SRAM, DRAM, EPROM, EEPROM, or other types of memory.

Briefly stated, the invention is related to an electroplating system that employs a divided electrode that is arranged to simultaneously provide a plurality of line currents for an electroplating process. The system includes a current control component that is coupled to the divided electrode. The current control component is configured to sense the magnitude of each of the line currents. The current control component is also configured to regulate individual line currents based, at least in part, on the sensed magnitude of each of the line currents.

In one embodiment, the current control component is configured to increase or decrease at least one of the line currents relative to another one of the line currents. In another embodiment, the current control component is configured to identify one of the line currents and to set each of the line currents to the magnitude associated with the identified current. For example, the current control component can identify a minimum current among the line currents and set each of the line currents to the magnitude corresponding to the minimum current.

FIG. 1 is a block diagram of an embodiment of an electroplating system for carrying out an electroplating process. Electroplating system 100 includes current control component 140, signal lines 135, power supply 130, processing chamber 120, electrode 108, and divided electrode 110 with separate electrode elements 112 having corresponding electrode fingers 113 for carrying microelectronic workpiece W and providing individual plating currents. Electrode 110 is arranged within processing chamber 120 and spaced apart from another electrode 108. In one embodiment, electrode 110 is in the form of a disc, and the electrode elements 112 are formed in the disc and separated from one another. In other embodiments, however, electrode 110 can have other shapes and/or other configurations of electrode elements 112 and electrode fingers 113. Also, processing chamber 120 can include other types of supports for carrying workpiece W, such as stand-off structures, clamps, or other devices for positioning workpiece W within processing chamber 120 and with respect to electrodes 108 and 110.

Processing chamber 120 is arranged to contain an electroplating solution 125. For example, processing chamber 120 can include a weir, a capsule, or other vessel. Electroplating solution 125 may contain any of a variety of electrolyte chemistries for electroplating one or more surface portions of workpiece W (e.g., dissolved gold, copper, aluminum, or other metal salts as well as other ions). Further, one of electrodes 108 and 110 can be composed of a metal that oxidizes to maintain a constant metal level in electroplating solution 125 during an electroplating process. Alternatively, the electrodes 108 and 110 can be configured such that they do not substantially corrode. For example, electroplating solution 125 can be replaced or replenished with another solution when the metal level of the solution is fully consumed or depleted beyond a certain level.

In one embodiment, electrode 110 is arranged as a cathode within processing chamber 120, and electrode 108 is arranged as anode within chamber 120. In other embodiments, however, other configurations are possible. For example, electrode 110 can be arranged as an anode, and electrode 108 can be arranged as a cathode. In addition or alternatively, electrode 108 can be configured to receive individual currents corresponding to specific electrode element of electrode 108. (in a manner similar to line currents $I_1$-$I_N$ received from electrode elements 112 of electrode 110).

Current control component 140 is arranged to receive line currents $I_1$-$I_N$ via signal lines 135. Line currents $I_1$-$I_N$ are collected at one of corresponding electrode elements 112 and correspond to an overall electroplating current $I_{PLATE}$ that conducts between power supply and electrode 110, including through portions of workpiece W and electroplating solution 125.

Current control component 140 is configured to sense the magnitude of each of line currents $I_1$-$I_N$ and to regulate line currents $I_1$-$I_N$ based, at least in part, on the sensed magnitude of each of line currents $I_1$-$I_N$. In one embodiment, current control component 140 provides a DC mode of line currents $I_1$-$I_N$. In another embodiment, current control component 140 provides an AC mode or pulsed mode of line currents $I_1$-$I_N$.

Constant-current power supply 130 is coupled to current control component 140 and arranged to provide a power supply voltage Vo at supply node $N_{POWER}$. In one embodiment, constant-current power supply is directly controlled by current control component 140 for adjusting the magnitude of electroplating current $I_{PLATE}$, which in turn simultaneously adjusts each of line currents $I_1$-$I_N$. For example, constant-current power supply 130 can include a single power supply circuit for simultaneously adjusting each of line currents $I_1$-$I_N$.

Figure 2:
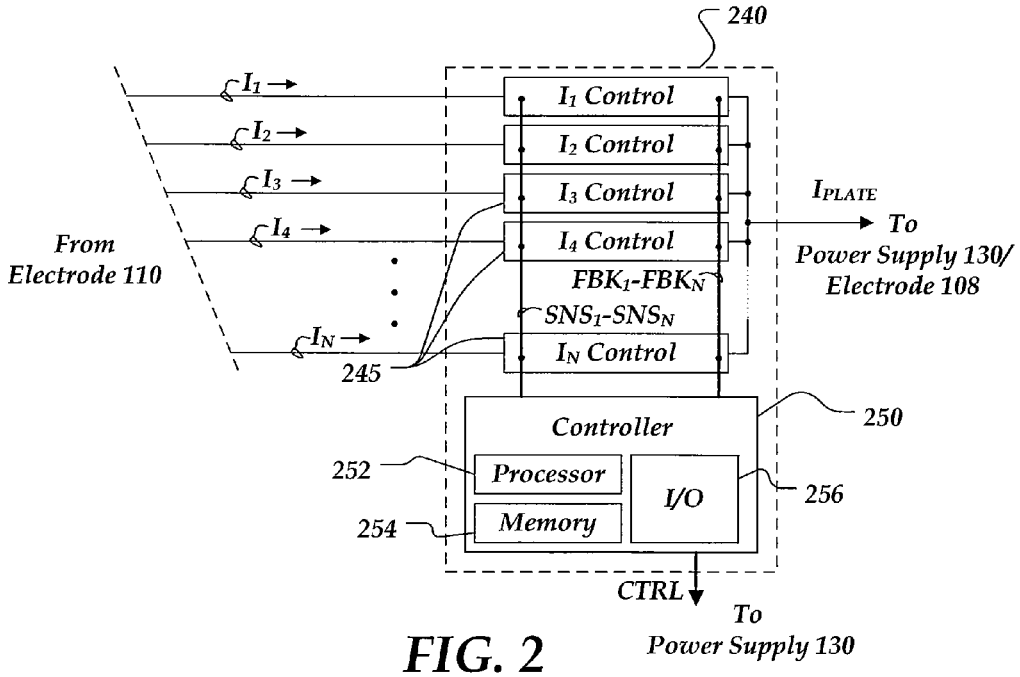
FIG. 2 is a block diagram of an embodiment of the current control component of FIG. 1.

FIG. 2 is a block diagram showing current control component 240, which may be employed as one embodiment of current control component 140 of FIG. 1. Current control component 240 includes individual current control elements 245 and controller circuit 250. Each of current control elements 245 is arranged to sense the magnitude of a corresponding line current and to provide one of sensing signals $SNS_1$-$SNS_N$ to controller circuit 250. Each of control elements 245 is also arranged to regulate one of line currents $I_1$-$I_N$ based, at least in part, on one or more feedback signals $FBK_1$-$FBK_N$ from controller circuit 250.

In one embodiment, the number N of sensing and feedback signals is related to the number of electrode elements employed in electrode 110 of FIG. 1. For example, if electrode 110 has 20 electrode elements, current control component 240 may employ 20 distinct sensing signals and 20 distinct feedback signals. In other embodiments, however, more or fewer sensing and feedback signals may be employed. For example, current control component 240 may employ one sensing signal and one feedback signal for a set of two electrode elements.

Current control elements 245 can include any of a variety of sensors for sensing or measuring the magnitude of a corresponding line current. In one embodiment, each of current control elements 245 includes an ammeter or an ammeter component. In another embodiment, each of current control elements 245 includes an in-line component, such as shunt-resistor, and/or an out of line component, such as an inductive coil.

Also, current control elements 245 can include any of a variety of devices for controlling the current flow of an individual line current based on feedback signals $FBK_1$-$FBK_N$. For example, each of current control elements 245 can include valve like devices, such as a variable resistor, a bipolar junction or field effect transistor, and/or another component for regulation based on feedback signals $FBK_1$-$FBK_N$.

Controller circuit 250 is arranged to receive sensing signals $SNS_1$-$SNS_N$ and to provide feedback signals $FBK_1$-$FBK_N$. Controller circuit 250 is also arranged to provide control signal CTRL to power supply 130 of FIG. 1 for controlling power supply voltage Vo.

Controller circuit 250 includes processor 252, memory 254, and input/output component ("I/O") 256. Memory 254 may include various types of permanent and temporary memory for containing processing instructions or recipes. Such processing instructions or recipes can include various types of programs for controlling current control elements 245 and/or power supply 130 via processor 252 and I/O 256.

I/O 256 can include components for receiving processing instructions and/or recipes from an operator. For example, I/O 256 can include a touch screen display, keypad, trackball, control panel, or the like. I/O 256 can also include other components and interfaces for managing and controlling sensing signals $SNS_1$-$SNS_N$, feedback signals $FBK_1$-$FBK_N$ and/or control signal CTRL, such as amplifiers, digital/analog or analog to digital converters, and other signal processing devices.

In one embodiment controller circuit 250 can be configured such that an operator can manually operate current control elements 245 and/or power supply 130. For example, processor 252 and/or memory 254 can be omitted or temporarily bypassed such the operator can directly control current control elements 245 and/or power supply 130. In another embodiment, controller circuit 250 can be configured to operate over a computer network so that an operator can provide processing instructions and/or recipes over the network or otherwise control controller circuit 250 remotely.

Figure 3:
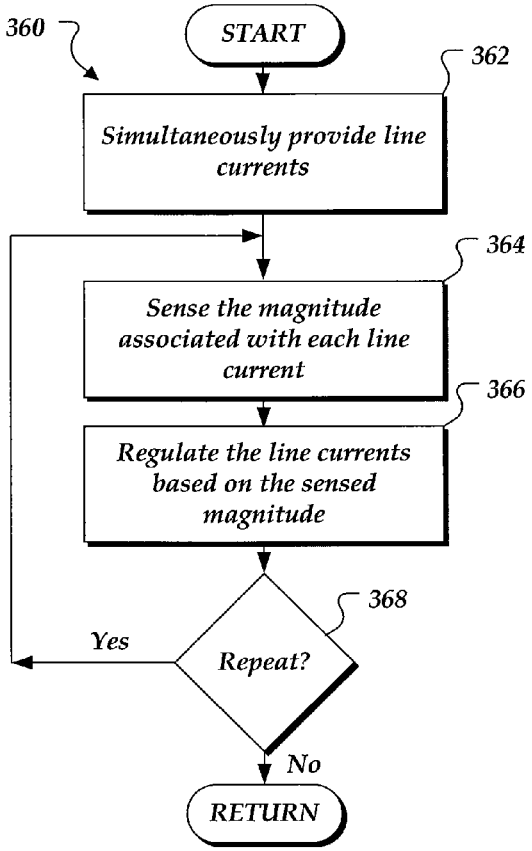
FIG. 3 is logical flow diagram showing an embodiment of an electroplating process.

FIG. 3 is logical flow diagram generally showing one embodiment of an electroplating process, which may be implemented by employing embodiments of electrode 110 and current control component 140 of FIG. 1. The invention, however, is not so limited and at least a portion of process 360 may be implemented within other components.

Process 360 begins, after a start block, at block 362, where a plurality of line currents are provided by a current control component. In one embodiment, the line currents may be provided to form a strike or seed layer on the surface of a microelectronic workpiece. In another embodiment, the line currents may be provided after a strike or seed layer had been formed in another electroplating or deposition process.

Processing continues to block 364, where the magnitude associated with each line current is sensed. For example, an ammeter or other type of sensor may be employed to sense or measure the magnitude of one line current relative to another line current. In one embodiment, a minimum, median, or maximum line current may be identified.

Processing continues to block 366, where the line currents are regulated based on the sensed magnitudes at block 364. For example, a variable resistor or other valve-like device may be employed to independently control each line current. Accordingly, each of the line currents can be independently adjusted at block 366 to maintain a uniform distribution of plating current. In conventional electroplating systems, by contrast, this is not typically possible because the distribution of line or plating currents is influenced by a contact condition between the circumference of a microelectronic workpiece and a power supply electrode.

In another embodiment, block 366 may be employed to compensate for thickness variations in a seed layer. For example, the line current corresponding to a thin region of the seed layer may be increased relative to one or more other line currents associated with thicker portions of the seed layer.

Figure 4:
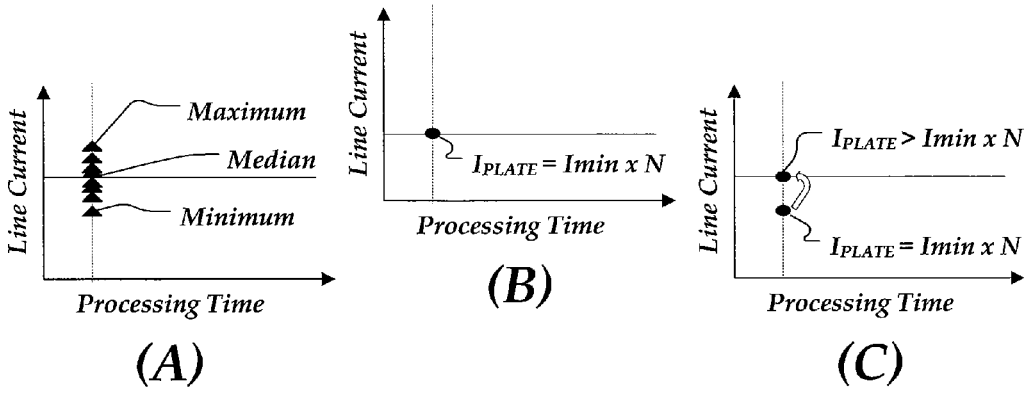
FIGS. 4A-4C are graphs showing line currents plotted vs. processing time.

In one embodiment, each of the line currents is set to the value associated with a minimum, median, maximum, or other identified line current among the line currents (described further with reference to FIGS. 4A and 4B). In another embodiment, the magnitude of plating current $I_{PLATE}$ may be increased/decreased at block 366 after the line currents have been set to the same magnitude (described further with reference to FIG. 4C).

Processing continue next to decision block 368, where processing may loop back to block 364 if further sensing and regulation is to be provided; otherwise processing flows to a calling process to perform other actions. In one embodiment, processing may loop back automatically to block 364 so that the line currents are updated in real-time. Alternatively, processing may loop back after a predetermined amount of time expires. In another embodiment, processing may loop back based on an operator command or a sensing condition. For example, processing may loop back if one or more of the line currents deviates in magnitude beyond a threshold.

FIG. 4A is a graph showing minimum, median, and maximum line currents identified among other line currents. In one embodiment described below in conjunction with FIGS. 4B and 4C, the minimum line current is employed for regulating each of the line currents.

FIG. 4B is a graph showing each of the line currents after being independently adjusted to the magnitude of the minimum line current identified in FIG. 4A. As a result of the adjustment, the overall electroplating current $I_{PLATE}$ has a magnitude equal to the magnitude of the minimum line current multiplied by the number N of line currents.

FIG. 4C is a graph showing overall electroplating current $I_{PLATE}$ being increased after setting each of the line currents to the minimum line current identified in FIG. 4A. In one embodiment, power supply 130 of FIG. 1 can increase/decrease electroplating current $I_{PLATE}$. For example, current control component 140 of FIG. 1 can sense a resistance associated with each line current, calculate an overall resistance, and use that overall resistance to determine the appropriate power supply voltage Vo to achieve a desired electroplating current $I_{PLATE}$.

Figure 5:
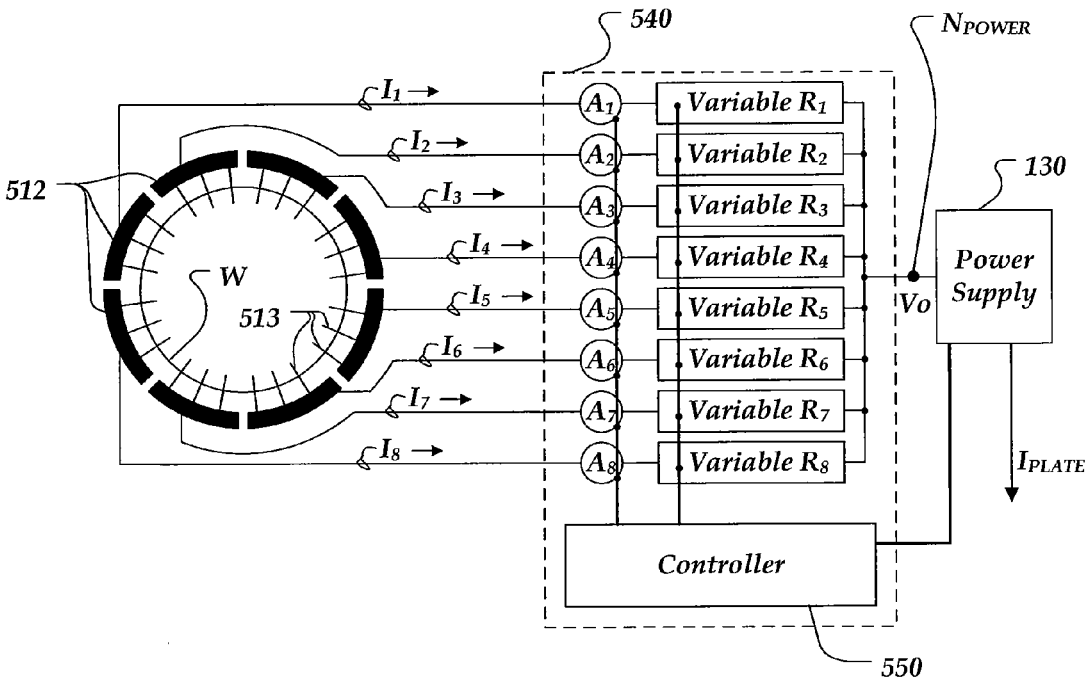
FIG. 5 is a block diagram showing another embodiment of a current control component.

FIG. 5 is a block diagram showing power supply 130 and another embodiment of a current control component, which may be employed as an embodiment of current control component 240 of FIG. 2. Current control component 540 includes controller 550, ammeter circuits $A_1$-$A_8$ arranged to receive sense signals $SNS_1$-$SNS_8$, and variable resistor circuits Variable $R_1$-Variable R8 arranged to provide feedback signals $FBK_1$-$FBK_8$.

Current control component 540 is coupled to divided electrode 510, which may be employed as an embodiment of electrode 110 of FIG. 1. Electrode 510 includes individual electrode elements 512 arranged to provide line currents $I_1$-$I_8$ via individual electrode fingers 513. Each of electrode elements 512 is arranged to provide a corresponding line current. Also, each of electrode elements 512 corresponds to an individual one of ammeter circuits ammeter circuits $A_1$-$A_8$ and an individual one of variable resistor circuits Variable $R_1$-Variable $R_8$.

Figure 6:
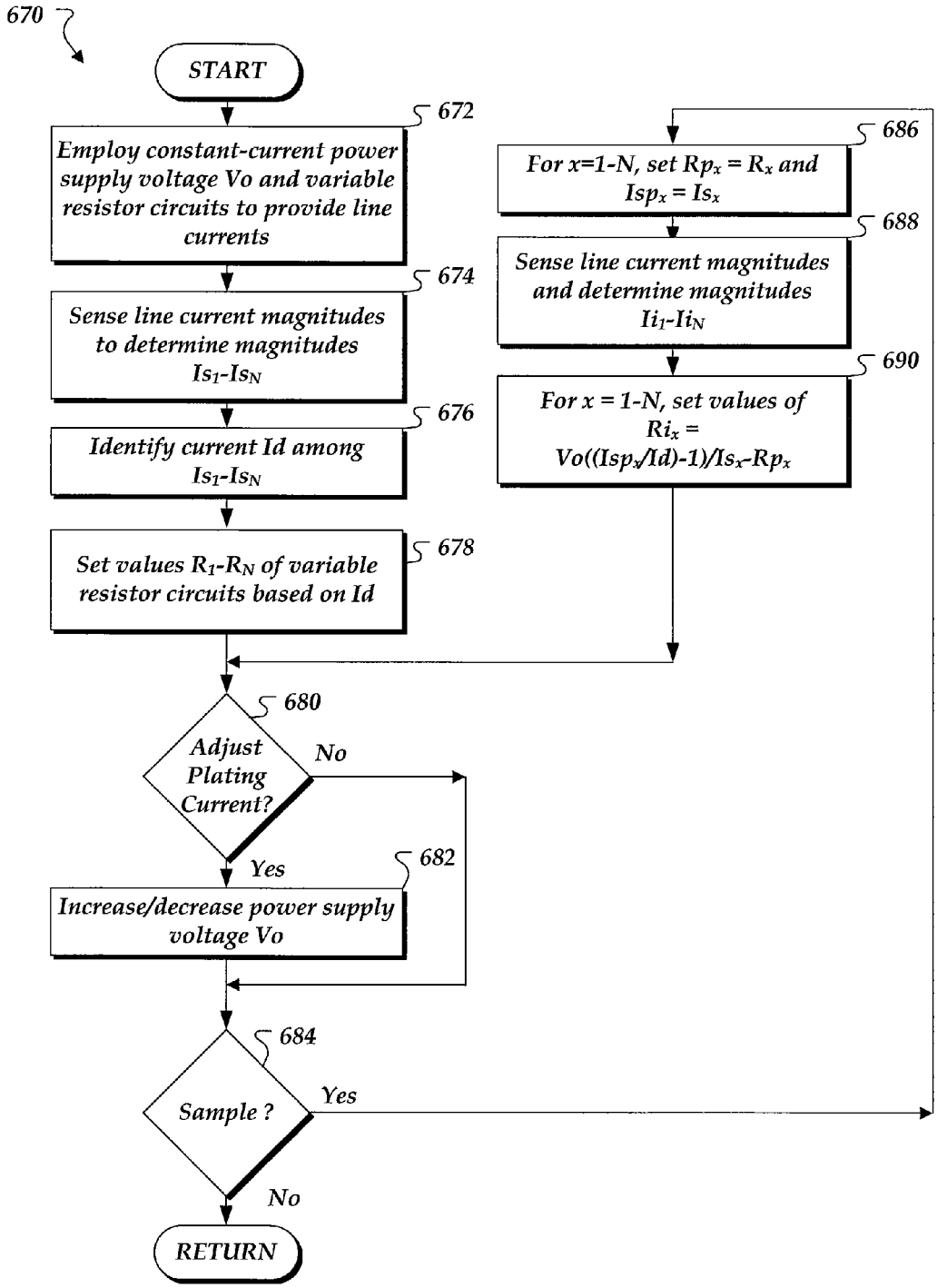
FIG. 6 is a logical flow diagram showing another embodiment of an electroplating process.

FIG. 6 is logical flow diagram generally showing one embodiment of an electroplating process, which may be implemented by employing embodiments of electrode 510 and current control component 540 of FIG. 5. The invention, however, is not so limited and at least a portion of process 670 may be implemented within other components.

Process 670 begins, after a start block, at block 672, where a constant-current power supply voltage Vo and variable resistor circuits are employed to provide line currents. Power supply voltage Vo may also provide a constant electroplating current at this time.

Processing continues to block 674, where each of the line currents are sensed to provide sampling current magnitudes $Is_1$-$Is_N$. In one embodiment, the value of the sampling magnitudes may be stored in permanent or temporary memory of a controller circuit.

Processing continues to block 676, where one of the line currents is identified as line current Id. For example, identified line current Id may be a minimum, maximum, or median line current. In one embodiment, line current Id is the minimum line current Imin of FIG. 4A.

Processing continues to block 678, where the resistance values $Ri_1$-$Ri_N$ of the variable resistor circuits are set based on the identified line current Id. For example, in one embodiment, if the identified line current Id is the minimum line current Imin of FIG. 4A, the resistance values may be appropriately increased or decreased so that each of the line currents is at a value equal to the minimum line current Imin (see, e.g., FIG. 4B).

Processing continues to decision block 680, where if the magnitude of the electroplating current is to be adjusted, processing continues to block 682; otherwise processing flows to decision block 684.

Processing continues to block 682, where the magnitude of the electroplating current is adjusted by increasing or decreasing the power supply voltage Vo. For example, the power supply voltage Vo can be increased or decreased based on the overall resistance of the resistance values $R_1$-$R_N$. In one embodiment, the electroplating current can be decreased to improve plating uniformity and/density. In another embodiment, the electroplating current can be increased to increase the plating rate. For example, block 682 may be employed to increase the plating current in a similar manner to that shown in FIG. 4C.

Processing continues to decision block 684, where if the resistance values of the variable resistance is to be sampled and adjusted, processing continues to block 686; otherwise processing flows to a calling process to perform other actions.

Processing continues to block 686, where the resistance values $R_1$-$R_N$ are stored as previous resistance values $Rp_1$-$Rp_N$. Also at block 686, the sampling magnitudes $Is_1$-$Is_N$ are set to previous sampling current magnitudes $Ipi_1$-$Ipi_N$. In one embodiment, the value of the previous sampling magnitudes and the previous resistance values may be stored in permanent or temporary memory of a controller circuit.

Processing continues to block 688, where each of the line currents is sensed to provide sampling magnitudes $Is_1$-$Is_N$. Sampling magnitudes $Is_1$-$Is_N$ may be different than previous sampling magnitudes $Ipi_1$-$Ipi_N$ (despite resistance values $R_1$-$R_N$ remaining unchanged) due to changes in the plating solution chemistry, changes in the contact resistance, changes in the workpiece resistance, and so on. In one embodiment, the step carried out at block 688 may be similar to the step carried out at block 674.

Processing continues to block 690, where the resistance values $R_1$-$R_N$ of the variable resistor circuits are set based on the identified line current Id, the power supply voltage Vo, the sampling magnitudes $Is_1$-$Is_N$, the previous sampling magnitudes $Ipi_1$-$Ipi_N$, and the previous resistance values $Rp_1$-$Rp_N$.

In one embodiment, the overall intrinsic resistance $Ro_x$ (e.g., associated with the plating solution chemistry, contact resistance, workpiece resistance, etc.) can be determined as follows:

$$Ro_x=(R_x+Rp_x)/((Is_x/Id)-1).$$

In one embodiment the determined value(s) of the overall intrinsic resistance can be used to further control an electroplating process. For example, the overall intrinsic resistance can be employed as a metric to monitor whether an electroplating process is within control limits.

Processing next flows back to decision block 680, where processing can continue to block 682 or 684, leading to a further electroplating current adjustment, another sampling, and/or a return to a calling process to perform other actions.

The above specification, examples and data provide a description of the manufacture and use of the composition of the invention. Since many embodiments of the invention can be made without departing from the spirit and scope of the invention, the invention also resides in the claims hereinafter appended.

What is claimed is:

1. An electroplating system, comprising:

a divided electrode that includes a conductive disc that is divided into a plurality of separate electrode elements, each electrode element having a plurality of electrode fingers, wherein the divided electrode is arranged to substantially simultaneously provide a plurality of line currents for an electroplating process via the plurality of separate electrode elements;

a power supply; and a current control component arranged between the divided electrode and the power supply, wherein the current control component comprises:

a plurality of current control elements coupled to the divided electrode, wherein each of the plurality of current control elements is configured to sense a magnitude of a corresponding one of the plurality of line currents and generate a corresponding sensing signal, and a controller circuit coupled to the plurality of current control elements, the controller circuit includes a processor that is configured to receive the corresponding sensing signal and generate a corresponding feedback signal to each of the plurality of current control elements.

2. The electroplating system of claim 1, wherein the current control component is configured to independently increase or decrease at least one of the line currents of the plurality of line currents relative to another one of the line currents of the plurality of line currents.

3. The electroplating system of claim 1, wherein the current control component is configured to identify one of the line currents of the plurality of line currents and to set each line current of the portion of the plurality of line currents to the current value associated with the identified line current.

4. The electroplating system of claim 1, wherein each of the plurality of current control elements includes an ammeter and a variable resistor.

5. The electroplating system of claim 4, wherein the ammeter is configured to sense the magnitude of the corresponding one of the plurality of line currents and generate the corresponding sensing signal, and the variable resistor is configured to receive the corresponding feedback signal and regulate the corresponding one of the plurality of line currents.

6. The electroplating system of claim 4, wherein the ammeter and the variable resistor of the each of the plurality of current control elements are located outside of a processing chamber of the electroplating system.

7. The electroplating system of claim 1, further comprising a processing chamber that is configured to contain an electroplating solution such that the current control component is electrically coupled to the electroplating solution via the divided electrode.

8. The electroplating system of claim 1, wherein the divided electrode includes a cathode, and wherein the electroplating system further comprises:

a processing chamber; and an anode arranged within the chamber to receive an electroplating current that is based, at least in part, on the plurality of line currents.

9. The electroplating system of claim 1, wherein the controller circuit is configured to operate over a computer network.

10. The electroplating system of claim 1, wherein the processor is further configured to generate a control signal to the power supply for controlling a voltage of the power supply between the current control component and the power supply.

11. An electroplating apparatus, comprising:

a processing chamber;

an electrode arranged within the processing chamber, wherein the electrode includes a plurality of electrode elements, each electrode element having a plurality of electrode fingers, that is configured to substantially simultaneously provide a plurality of line currents for an electroplating process;

a power supply;

a plurality of ammeters coupled to the plurality of electrode elements wherein each of the plurality of ammeters is configured to sense a magnitude of a corresponding one of the plurality of line currents and generate a corresponding sensing signal;

a plurality of variable resistors coupled between the plurality of ammeters and power supply; and a controller circuit coupled to the plurality of ammeters and the plurality of variable resistors, the controller circuit includes a processor configured to receive the corresponding sensing signal and generate a corresponding feedback signal to each of the plurality of variable resistors.

12. The electroplating apparatus of claim 11, wherein the plurality of ammeters and the plurality of variable resistors are located outside of the processing chamber.

13. The electroplating apparatus of claim 11, wherein the processor is further configured to generate a control signal to the power supply for controlling a voltage of the power supply between the plurality of variable resistors and the power supply.

* * * * *